US006382872B1

(12) United States Patent
Winterskov

(10) Patent No.: US 6,382,872 B1
(45) Date of Patent: May 7, 2002

(54) METHOD AND APPLICATION APPARATUS FOR ROAD MARKING

(75) Inventor: Bo Winterskov, Nyborg (DK)

(73) Assignee: Rieber & Søn ASA, Bergen (NO)

( * ) Notice: Subject to any disclaimer, the term of this patent is extended or adjusted under 35 U.S.C. 154(b) by 0 days.

(21) Appl. No.: 09/529,320

(22) PCT Filed: Oct. 13, 1998

(86) PCT No.: PCT/DK98/00446

§ 371 Date: Jun. 22, 2000

§ 102(e) Date: Jun. 22, 2000

(87) PCT Pub. No.: WO99/22073

PCT Pub. Date: May 6, 1999

(30) Foreign Application Priority Data

Oct. 13, 1997 (DK) ..... 1997 01163

(51) Int. Cl.[7] ..... E01C 23/16

(52) U.S. Cl. ..... 404/94; 404/93

(58) Field of Search ..... 404/93, 94; 239/146, 239/147, 150, DIG. 14; 118/108, 207, 305; 427/136, 137

(56) References Cited

U.S. PATENT DOCUMENTS

| | | | | |
|---|---|---|---|---|
| 4,572,703 A | | 2/1986 | Moller | 404/94 |
| 4,930,431 A | * | 6/1990 | Alexander | 111/164 |

FOREIGN PATENT DOCUMENTS

| | | | | |
|---|---|---|---|---|
| DE | 2844630 | * | 4/1979 | 404/93 |
| DE | 3728250 | | 3/1989 | |
| DK | 158841 | | 7/1985 | |
| DK | 166378 | | 3/1986 | |
| GB | 2108181 | * | 5/1983 | 404/93 |
| WO | 8601748 | | 3/1986 | |
| WO | 0422346 | | 4/1991 | |

* cited by examiner

*Primary Examiner*—David Bagnell
*Assistant Examiner*—Sunil Singh
(74) *Attorney, Agent, or Firm*—Antonelli, Terry, Stout & Kraus, LLP

(57) ABSTRACT

The invention concerns a method and an apparatus for the application of a marking (1) on a road surface (2), said apparatus comprising a vehicle which moves the apparatus over the surface (2). The marking material (3) is led from a supply container (4) to a distribution chamber (6) which, via a shutter (11), under slight pressure presses a band (12) of the marking material (3) out through an opening (14). The band of material (12) is led out towards a rotating axle (7) with blades (9). The material (3) in the band of material (12) is hereby divided into equal part elements (13) without the blades (9) touching the chamber (6) or any other parts of the apparatus. The influence of wear on the apparatus is hereby considerably reduced, even when use is made of material (3) containing abrasive additives. The part elements (13) are thrown to the rear and down against the surface (2) by the blades (9), where the material which is viscous at the moment of application stiffens in the form of elements (13) which constitute the finished marking (1).

10 Claims, 2 Drawing Sheets

METHOD AND APPLICATION APPARATUS FOR ROAD MARKING

BACKGROUND OF THE INVENTION

1. Field of the Invention

Figure 1:
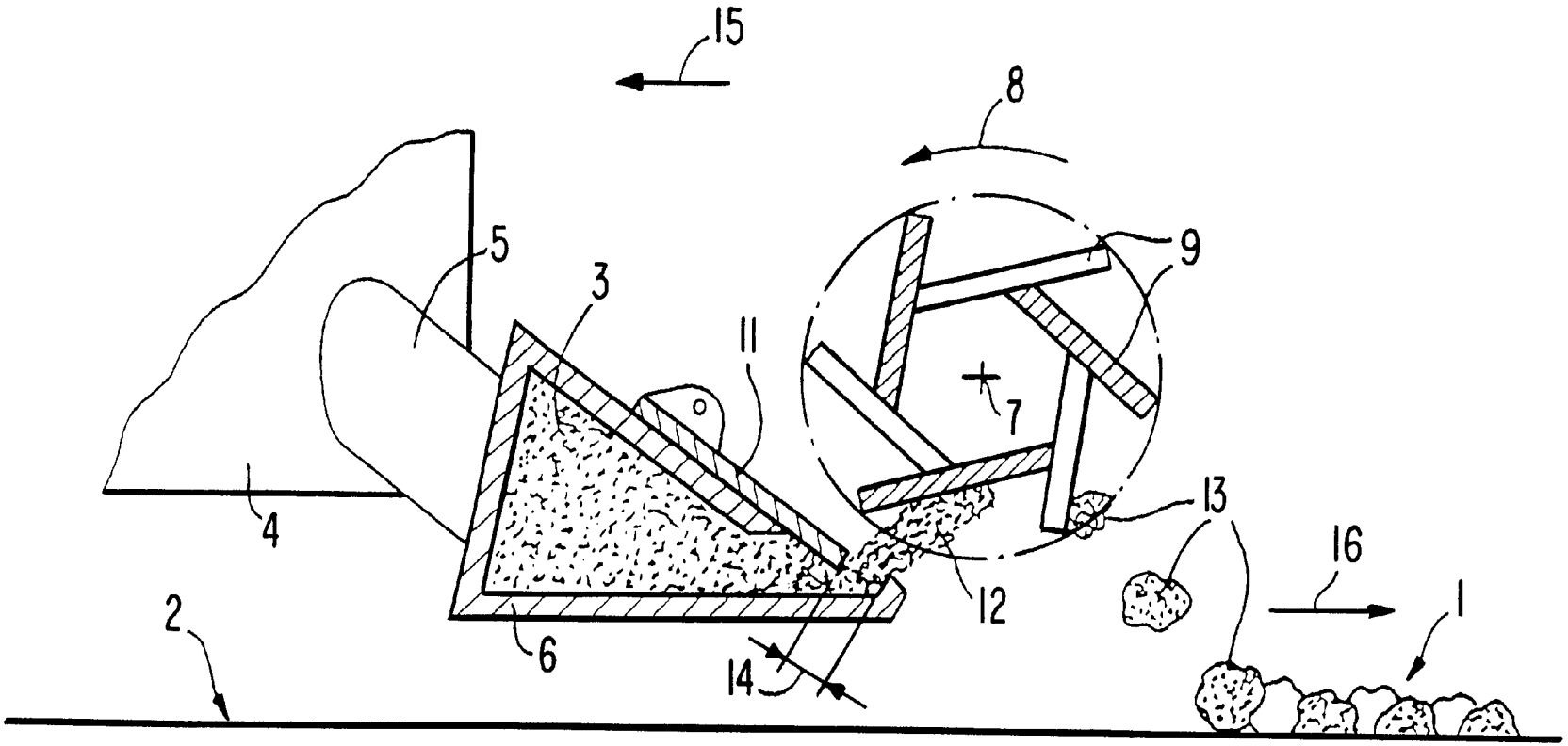

The invention concerns a method for the application of marking on a road surface by use of a material which is viscous at the moment of application, and which from a supply chamber is led under pressure through a discharge opening, after which a number of rotating blades sweep-off the material which is thereafter thrown against the road surface in the formation of the marking, and an application apparatus for the execution of the method.

2. Description of the Prior Art

Road markings in the form of road stripes are known either as punctiform markings or as transverse beams. These forms of markings are expedient since they are not only very visible because they reflect light over a broad spectrum, but also provide good draining-off conditions for the water on the road. Moreover, driving over the markings will result in fairly strong vibrations as a warning to the driver of the vehicle.

In order to safeguard against skidding, it is known to add various friction-promoting additives to the material before it is led out and applied.

This additive can e.g. be sand, gravel, quartz grains or crushed glass.

However, the use of such additives leads to such great wear on parts of the application apparatus, especially the part around the discharge opening and the blades, that this results in a seriously limited lifetime and herewith frequent replacement of parts and repairs.

An apparatus which has been developed for use without additives is known from the description of DK 166378 B.

It appears from this publication that the individual blades sweep the discharge openings and the ledge on which the material is led out.

Naturally, this physical contact gives rise to a certain degree of wear, but this in itself is not so great that it limits the use of the apparatus.

However, if the material supplied contains additives in the form of hard materials, this will have such a harmful effect on both the discharge part and the blades that after a short period of use the apparatus is no longer functional.

SUMMARY OF THE INVENTION

The invention overcomes the disadvantages and drawbacks of the known methods, and this is achieved according to the invention by a method whereby the material is fed out in a coherent material flow, and blades carry the material flow from the free end thereof at a distance from the discharge opening.

In a simple manner, it is hereby achieved that the material can be carried by the blades completely without the material getting "pinched" between the supply parts and the blades.

The additive will thus neither damage nor give rise to wear or deformations on the mechanical parts of the apparatus, and therefore the method permits a trouble-free application of the material, even when it contains additives in large amounts or with large grain sizes.

By configuring the apparatus of the invention with blades which move past the delivery opening(s) at a relatively great distance, the apparatus will be able to effect the method without any reduction in the speed of application or the quality of the marking.

By providing the apparatus with several discharge openings each with their own shutter, the flow of material can be dimensioned so that the marking on the road has a sloping or convex cross-sectional form.

By mounting the blades at mutual distances on an axle, the axial length of the blades will be limited and the amount of material swept off will therefore be correspondingly limited.

By configuring the blades with full length across the discharge openings, the markings which result will be in the form of transverse beams.

THE DRAWING

Figure 2:
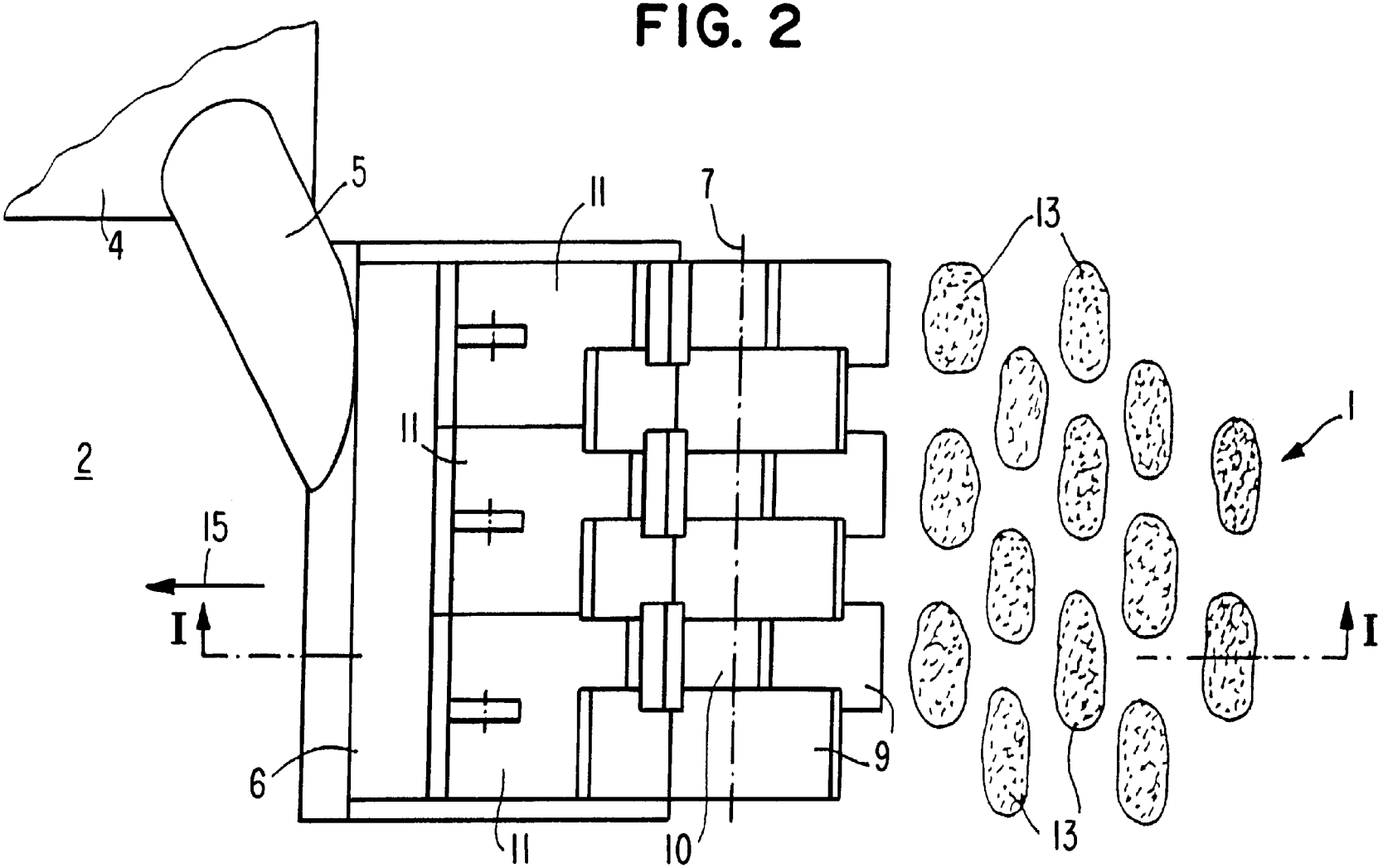

An example of a preferred embodiment of an apparatus according to the invention will now be described with reference to the drawings, where FIG. 1 shows a section through the apparatus, seen in the direction 1—1 in FIG. 2, and where FIG. 2 shows the apparatus seen from above.

DESCRIPTION OF PREFERRED EMBODIMENTS OF THE INVENTION

In FIG. 1 is shown an example embodiment of the apparatus of the invention during operation.

The apparatus is mounted on a vehicle which is not shown, but this vehicle requires only the ability to bear the necessary weight and move in the desired direction and at the desired speed over the road 2, as indicated by the arrow 15.

The supply chamber 6 is configured as a chamber with triangular cross-section, in which the marking material 3 stands under a light pressure so that it can be led out through an opening 14 which is regulated by a shutter 11.

The material will thus be led out in the form of a band 12 which hangs freely after the discharge opening 14. The blades 9, which are mounted on a rotating axle 7, will be fed into the course of the band 12 of material when the axle rotates.

The marking material 3 is supplied to the chamber 6 from a supply container 4 via a pipe 5. The consistency of the material is viscous, which is normally achieved by using a thermoplastic material which is held suitably heated.

A light pressure on the material can hereby give rise to the pressing out of the desired band of material 12.

Driven by a road-wheel or other means, the axle 7 with the blades 9 rotates counter-clockwise as shown by the arrow 8.

It can be observed that the space between the rotating blades 9 and the opening 14 from the supply chamber 6 can be several centimeters, corresponding to the distance between the circle of rotation for the blades, shown by the dot-dash line, and the discharge opening 14 in FIG. 1.

FIG. 2 shows the apparatus seen from above.

The shutter 11 can be divided into more sections for adjusting the breadth of the marking 1 on the road 2.

The blades 9 can be produced in a given width, in the illustrated example corresponding to ⅙ of the breadth of the marking 1, and with spaces 10 between the blades in each row.

The blades can also be of a width corresponding to the width of the marking 1, and in such case the marking will be in the form of transverse beams instead of the round marking blobs 13 as shown.

The apparatus described can thus perform the method, which means that there is no unnecessary wear between the mechanical parts even when the material contains hard additive materials, and since the apparatus can function at high speeds, the method ensures that the speed of application can be relatively high with blobs of material 13 being thrown against the surface of the road 2 at such a low velocity that there is no risk that the blobs of material are deformed at the moment of impact. The low velocity is the result of the backwards velocity 16, which is imparted to the material 13 by the rotating blades 9, substantially matching the vehicle velocity 15.

What is claimed is:

1. A method for the application of markings on a road surface using a material which is viscous at the moment of application comprising:

feeding the viscous material out of a supply chamber under pressure through a discharge opening as a viscous material flow;

impacting the viscous material flow after passage through the discharge opening with rotating blades to cause impact against the road surface to form the markings; and the blades are located at a sufficient distance from the discharge opening that the viscous material flow at a free end thereof does not pinch between the rotating blades and the discharge opening.

2. An apparatus for execution of the method according to claim 1, wherein:

the rotating blades have a maximum radius in a radial direction which is less than a distance to the discharge opening so that the rotating blades freely rotate without touching the discharge opening or other fixed parts of the supply chamber.

3. An apparatus according to claim 2, wherein:

the supply chamber is provided with discharge openings with shutters providing individual material flows which mark the road surface.

4. An apparatus in accordance with claim 3, wherein:

the supply chamber, the discharge opening and the rotating blades are conveyed in a first direction by a vehicle providing a vehicular velocity thereof in the first direction; and a velocity component is imparted to the viscous material flow at the free end by impact with the rotating blades in a second direction, opposite to the first direction, which reduces the velocity of the viscous material at impact with the road surface so that the viscous material does not deform at impact with the road surface.

5. An apparatus according to claim 2, wherein:

the rotating blades are mounted with an axial separation to form markings which are separated on the road.

6. An apparatus in accordance with claim 5, wherein:

the supply chamber, the discharge opening and the rotating blades are conveyed in a first direction by a vehicle providing a vehicular velocity thereof in the first direction; and a velocity component is imparted to the viscous material flow at the free end by impact with the rotating blades in a second direction, opposite to the first direction, which reduces the velocity of the viscous material at impact with the road surface so that the viscous material does not deform at impact with the road surface.

7. An apparatus according to claim 2, wherein:

the blades extend across a whole length of the discharge opening to cause formation of continuous markings on the road surface.

8. An apparatus in accordance with claim 7, wherein:

the supply chamber, the discharge opening and the rotating blades are conveyed in a first direction by a vehicle providing a vehicular velocity thereof in the first direction; and a velocity component is imparted to the viscous material flow at the free end by impact with the rotating blades in a second direction, opposite to the first direction, which reduces the velocity of the viscous material at impact with the road surface so that the viscous material does not deform at impact with the road surface.

9. An apparatus in accordance with claim 2, wherein:

the supply chamber, the discharge opening and the rotating blades are conveyed in a first direction by a vehicle providing a vehicular velocity thereof in the first direction; and a velocity component is imparted to the viscous material flow at the free end by impact with the rotating blades in a second direction, opposite to the first direction, which reduces the velocity of the viscous material at impact with the road surface so that the viscous material does not deform at impact with the road surface.

10. A method in accordance with claim 1, wherein:

the supply chamber, the discharge opening and the rotating blades are conveyed in a first direction by a vehicle providing a vehicular velocity thereof in the first direction; and a velocity component is imparted to the viscous material flow at the free end by impact with the rotating blades in a second direction, opposite to the first direction, which reduces the velocity of the viscous material at impact with the road surface so that the viscous material does not deform at impact with the road surface.

* * * * *